US008172516B2

(12) United States Patent
Parker et al.

(10) Patent No.: US 8,172,516 B2
(45) Date of Patent: May 8, 2012

(54) VARIABLE GEOMETRY TURBINE

(75) Inventors: John Frederick Parker, Huddersfield (GB); David Luck, Huddersfield (GB); David H. Brown, Huddersfield (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 0 days.

(21) Appl. No.: 11/999,875

(22) Filed: Dec. 7, 2007

(65) Prior Publication Data

US 2008/0089782 A1 Apr. 17, 2008

Related U.S. Application Data

(63) Continuation of application No. PCT/GB2006/002069, filed on Jun. 6, 2006.

(30) Foreign Application Priority Data

Jun. 7, 2005 (GB) ..... 0511613.2
Jul. 14, 2005 (GB) ..... 0514465.4

(51) Int. Cl.
*F01D 17/14* (2006.01)

(52) U.S. Cl. ..... 415/151

(58) Field of Classification Search ..... 415/116, 415/151, 167
See application file for complete search history.

(56) References Cited

U.S. PATENT DOCUMENTS

| | | | | |
|---|---|---|---|---|
| 3,478,955 | A * | 11/1969 | Kunderman | 417/507 |
| 6,203,272 | B1 | 3/2001 | Walsham | |
| 6,776,574 | B1 | 8/2004 | Parker | |
| 6,931,849 | B2 * | 8/2005 | Parker | 60/602 |
| 7,150,151 | B2 * | 12/2006 | Mulloy et al. | 60/602 |

FOREIGN PATENT DOCUMENTS

| | | | |
|---|---|---|---|
| EP | 654 587 | A1 | 5/1995 |
| JP | 60-175707 | | 9/1985 |
| JP | 60175707 | A | 9/1985 |
| WO | WO 2006/131724 | | 12/2006 |

* cited by examiner

*Primary Examiner* — Edward Look
*Assistant Examiner* — Sean J Younger
(74) *Attorney, Agent, or Firm* — Krieg DeVault LLP; Matthew D. Fair, Esq.

(57) ABSTRACT

A variable geometry turbine comprises a turbine wheel (9) supported in a housing (1) for rotation about an axis. A nozzle ring (5) is moveably mounted within a cavity (19) provided within the housing for adjustment of the width of an annular inlet passageway (4) extending radially inwards towards the turbine wheel (9). An array of inlet guide vanes (8) extends between a radial face of the nozzle ring (5) and an opposing wall of the inlet (4) defining a radial vane passage. A first circumferential array of apertures (25) is provided through the radial face, each of which lies substantially within the vane passage. A second circumferential array of apertures (24) is also provided in said radial face, each of lies substantially upstream or downstream of the first array (25) of apertures. The inlet (4) and cavity (19) are in fluid communication via both the first and second sets of apertures (25,24).

22 Claims, 5 Drawing Sheets

VARIABLE GEOMETRY TURBINE

The present application is a continuation of PCT/GB2006/002069 filed on Jun. 6, 2006. which claims the benefit of United Kingdom Patent Application No. GB0514465.4 filed Jul. 14, 2005 and United Kingdom Patent Application No. GB0511613.2 filed Jun. 7, 2005. Each of the above-referenced applications are incorporated herein by reference.

The present invention relates to a variable geometry turbine, particularly, but not exclusively, for use in a turbocharger of an internal combustion engine.

BACKGROUND OF THE INVENTION

Turbochargers are well known devices for supplying air to the intake of an internal combustion engine at pressures above atmospheric pressure (boost pressures). A conventional turbocharger essentially comprises an exhaust gas driven turbine wheel mounted on a rotatable shaft within a turbine housing. Rotation of the turbine wheel rotates a compressor wheel that is mounted on the other end of the shaft and within a compressor housing. The compressor wheel delivers compressed air to the engine intake manifold. The turbocharger shaft is conventionally supported by journal and thrust bearings, including appropriate lubricating systems, located within a central bearing housing connected between the turbine and compressor wheel housings.

In known turbochargers, the turbine comprises a turbine chamber within which the turbine wheel is mounted, an annular inlet passageway defined between facing radial walls arranged around the turbine chamber, an inlet arranged around the inlet passageway, and an outlet passageway extending from the turbine chamber. The passageways and chambers communicate in such a way that pressurised exhaust gas admitted to the inlet chamber flows through the inlet passageway to the outlet passageway via the turbine and rotates the turbine wheel. It is also well known to trim turbine performance by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suit varying engine demands. For instance, when the volume of exhaust gas being delivered to the turbine is relatively low, the velocity of the gas reaching the turbine wheel is maintained at a level that ensures efficient turbine operation by reducing the size of the annular inlet passageway.

In one known type of variable geometry turbine, an axially moveable wall member, generally referred to as a "nozzle ring", defines one wall of the inlet passageway. The position of the nozzle ring relative to a facing wall of the inlet passageway is adjustable to control the axial width of the inlet passageway. Thus, for example, as gas flowing through the turbine decreases, the inlet passageway width may also be decreased to maintain gas velocity and to optimise turbine output. Such nozzle rings essentially comprise a radially extending wall and inner and outer axially extending annular flanges. The annular flanges extend into an annular cavity defined in the turbine housing, which is a part of the housing that in practice is provided by the bearing housing, which accommodates axial movement of the nozzle ring.

The nozzle ring may be provided with vanes that extend into the inlet passageway and through slots provided on the facing wall of the inlet passageway to accommodate movement of the nozzle ring. Alternatively, vanes may extend from the fixed wall through slots provided in the nozzle ring. Generally the nozzle ring is supported on rods extending parallel to the axis of rotation of the turbine wheel and is moved by an actuator that axially displaces the rods. Various forms of actuators are known for use in variable geometry turbines, including pneumatic, hydraulic and electric actuators that are mounted externally of the turbocharger and connected to the variable geometry system via appropriate linkages.

When a conventional turbine is in use, with gas passing through the inlet passageway, pressure is applied to the face of the nozzle ring tending to force the nozzle ring into the annular cavity. There is pressure in the annular cavity in which the nozzle ring sits and the actuating mechanism must overcome the effect of this pressure if the position of the nozzle ring is to be controlled accurately. Moving the nozzle ring closer to the facing wall of the passageway, so as to further reduce the width of the passageway and increase the speed of the air flow, tends to increase the load applied to the face of the nozzle ring. Some actuators for turbines, for example electric actuators, are able to provide only a relatively limited force to move a nozzle ring when compared to pneumatic actuators. In some operating conditions, the force needed to be supplied by the actuator can exceed the capability of the actuator. Furthermore, it is also desirable to ensure that the resultant force on the nozzle ring is unidirectional.

EP 0654587 discloses a variable geometry turbine with pressure balance apertures in the nozzle ring between nozzle vanes. The forces on the nozzle ring are created by the pressure on the nozzle ring face, the pressure in the cavity behind the nozzle ring, and by the actuator. The function of the pressure balance apertures is to ensure that the cavity behind the nozzle ring is at a pressure substantially equal to, but always slightly less than, the pressure acting on the front face of the nozzle ring to ensure a small but unidirectional force on the nozzle ring.

The turbine nozzle ring is usually provided with an annular array of vanes extending across the turbine inlet. Air flowing through the inlet flows radially between adjacent vanes that can therefore be regarded as defining a vane passage. The turbine inlet has a reduced radial flow area in the region of the vane passage with the effect that the inlet gas speed increases through the vane passage with a corresponding drop in pressure in this region of the nozzle ring. Accordingly, the pressure balance holes as described in EP 0 654 587 are located between vanes in the sense that the inner and/or outer extremity of each balance aperture lies within the inner or outer radial extent of the nozzle guide vane passage.

It has been found that even with the provision of pressure balance holes as disclosed in EP 0 654 587, the force on the nozzle ring can fluctuate undesirably as the pressure within the turbine inlet fluctuates due to exhaust pulses being released into the exhaust manifold of the vehicle engine by the opening and closing action of the exhaust valves. This force fluctuation is present both when the turbocharger is operating in an engine "fired" mode and also an engine "braking" mode. For instance, in braking mode the force fluctuation can give rise to an undesirable fluctuation in the breaking torque produced.

The terms "fired" mode and "braking" mode are well known to the ordinarily skilled artisan in this field

SUMMARY OF THE INVENTION

It is an object of the present invention to obviate or mitigate the above disadvantage.

In accordance with the present invention there is provided a variable geometry turbine comprising a turbine wheel supported in a housing for rotation about an axis, an axially movable annular wall member mounted within a cavity provided within the housing, an annular inlet passageway extending radially inwards towards the turbine wheel and defined between a radial face of the movable wall member and an opposing wall of the housing, the movable wall member being axially movable relative to the housing to vary the axial width of the inlet passageway, an array of inlet guide vanes extending between the radial face and opposing wall defining a radial vane passage, a first circumferential array of apertures provided through said radial face, each of said first array of apertures lying substantially within the vane passage, and a second circumferential array of apertures in said radial face, each of said second array of apertures lying substantially upstream or downstream of said first array of apertures relative to the direction of flow through the inlet, such that the inlet and said cavity are in fluid communication via both the first and second sets of apertures.

It has been found that the force amplitude at the actuator interface caused by an exhaust pulse passing through the turbine stage can be reduced by over 75% in the case of a braking condition and by over 80% in the case of a fired condition by the provision of primary and secondary pressure balance apertures in the nozzle ring when compared with the provision of primary pressure balance apertures, alone. Thus, the present invention enables a low mean force on the nozzle ring to be present over a range of engine speeds.

BRIEF DESCRIPTION OF THE DRAWINGS

A specific embodiment of the present invention will now be described, by way of example, with reference to the accompanying drawings.

DETAILED DESCRIPTION OF THE PREFERRED EMBODIMENTS

Figure 1B:
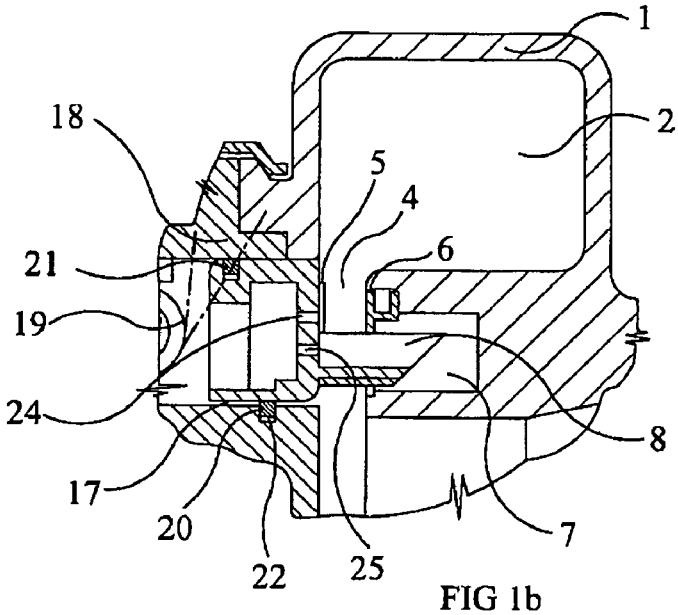
FIG. 1*b* is a cross-section of a part of the turbine of FIG. 1*a;*
Figure 1A:
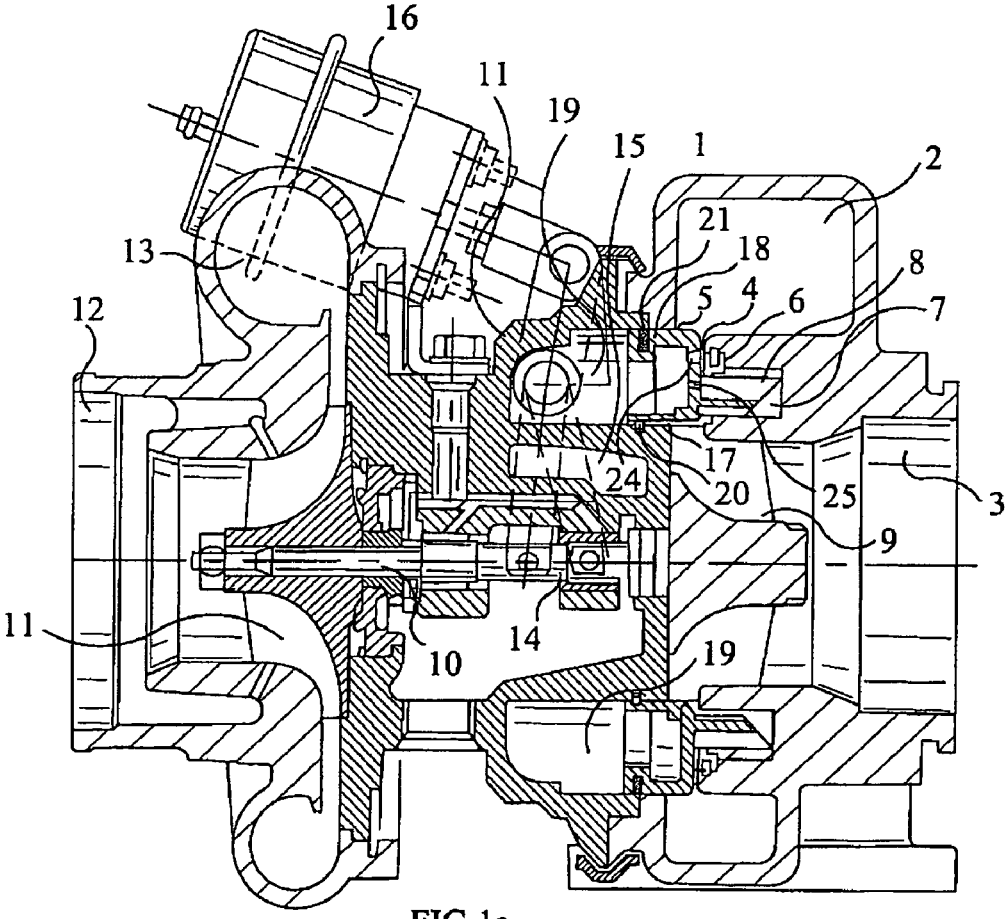
FIG. 1*a* is an axial cross-section of a variable geometry turbine, in accordance with the present invention.

Referring to FIG. 1*a*, the illustrated variable geometry turbine comprises a turbine housing 1 defining an inlet chamber 2 to which gas from an internal combustion engine (not shown) is delivered. The exhaust gas flows from the inlet chamber 2 to an outlet passageway 3 via an annular inlet passageway 4. The inlet passageway 4 is defined on one side by the face of a movable annular wall member 5, commonly referred to as a "nozzle ring," and on the opposite side by an annular shroud 6, which covers the opening of an annular recess 7 in the facing wall.

Gas flowing from the inlet chamber 2 to the outlet passageway 3 passes over a turbine wheel 9 and as a result torque is applied to a turbocharger shaft 10 that drives a compressor wheel 11. Rotation of the compressor wheel 11 pressurizes ambient air present in an air inlet 12 and delivers the pressurized air to an air outlet 13 from which it is fed to an internal combustion engine (not shown). The speed of the turbine wheel 9 is dependent upon the velocity of the gas passing through the annular inlet passageway 4. For a fixed rate of mass of gas flowing into the inlet passageway, the gas velocity is a function of the width of the inlet passageway 4, the width being adjustable by controlling the axial position of the nozzle ring 5. As the width of the inlet passageway 4 is reduced, the velocity of the gas passing through it increases. FIG. 1*a* shows the annular inlet passageway 4 closed down to a minimum width, whereas in FIG. 1*b* the inlet passageway 4 is shown fully open.

The nozzle ring 5 supports an array of circumferentially and equally spaced vanes 8, each of which extends across the inlet passageway 4. The vanes 8 are orientated to deflect gas flowing through the inlet passageway 4 towards the direction of rotation of the turbine wheel 9. When the nozzle ring 5 is proximate to the annular shroud and to the facing wall, the vanes 8 project through suitably configured slots in the shroud 6 and into the recess 7.

A pneumatically operated actuator 16 is operable to control the position of the nozzle ring 5 via an actuator output shaft (not shown), which is linked to a stirrup member (not shown). The stirrup member in turn engages axially extending guide rods (not shown) that support the nozzle ring 5. Accordingly, by appropriate control of the actuator 16 the axial position of the guide rods and thus of the nozzle ring 5 can be controlled. It will be appreciated that electrically operated actuators could be used in place of a pneumatically operated actuator.

The nozzle ring 5 has axially extending inner and outer annular flanges 17 and 18 respectively that extend into an annular cavity 19 provided in the turbine housing. Inner and outer sealing rings 20 and 21, respectively, are provided to seal the nozzle ring 5 with respect to inner and outer annular surfaces of the annular cavity 19, while allowing the nozzle ring 5 to slide within the annular cavity 19. The inner sealing ring 20 is supported within an annular groove 22 formed in the inner surface of the cavity 19 and bears against the inner annular flange 17 of the nozzle ring 5, whereas the outer sealing ring 21 is supported within an annular groove 23 provided within the annular flange 18 of the nozzle ring 5 and bears against the radially outermost internal surface of the cavity 19. It will be appreciated that the inner sealing ring 20 could be mounted in an annular groove in the flange 17 rather than as shown, and/or that the outer sealing ring 21 could be mounted within an annular groove provided within the outer surface of the cavity rather than as shown.

Figure 1C:
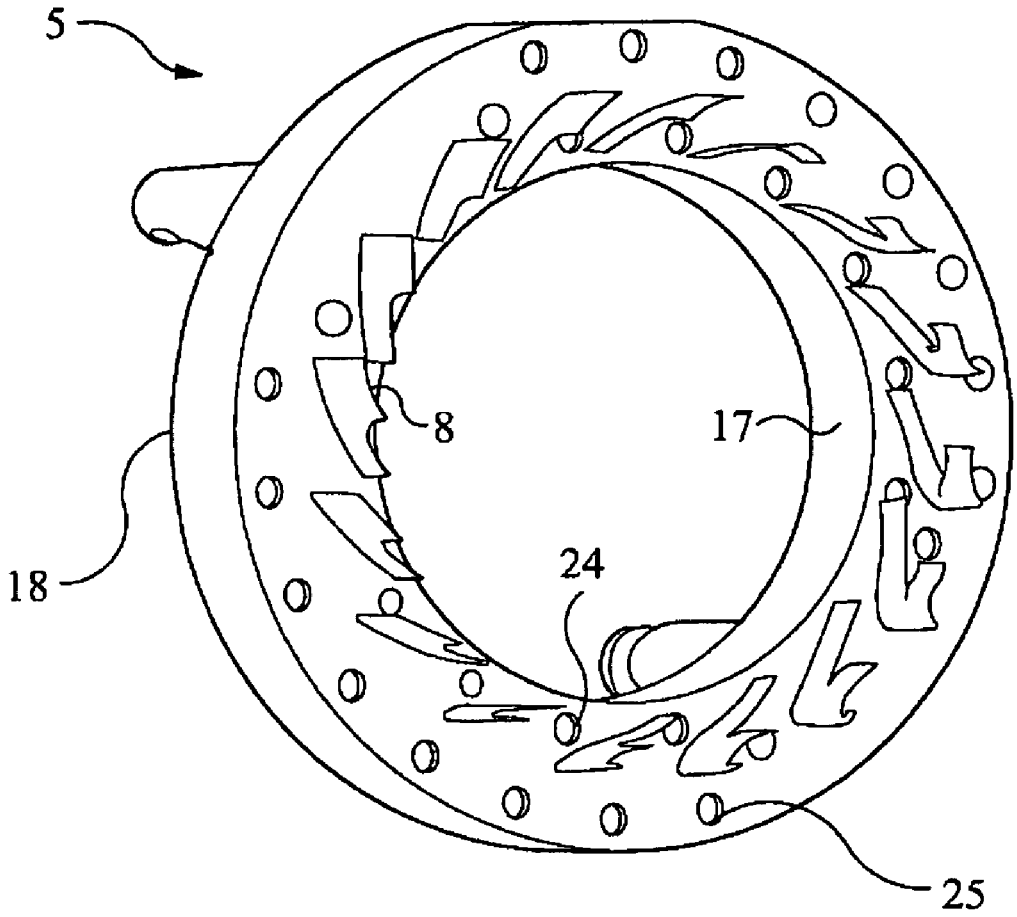
FIG. 1*c* is a perspective view of the nozzle ring shown in FIGS. 1*a* and 1*b;*

As shown in FIG. 1*c* the nozzle ring 5 is provided with first and second circumferential arrays of pressure balance apertures 24, 25, the first set of pressure balance apertures 25 being disposed within the vane passage defined between adjacent vanes 8. The second set of pressure balance apertures 24 is disposed outside the radius of the nozzle vane passage.

The first and second pressure balance apertures 24, 25 allow the annular inlet passageway to be in fluid communication with the annular cavity 19, which is otherwise sealed off from inlet passageway 4 by sealing rings 20 and 21.

It has been found that the force amplitude at the actuator interface caused by exhaust pulses passing through the turbine stage can be reduced by over 80% by the addition of the second set of pressure balance apertures 24, when compared with the provision of a first set of pressure balance apertures 24 (located in the vane passage), alone.

Figure 2:
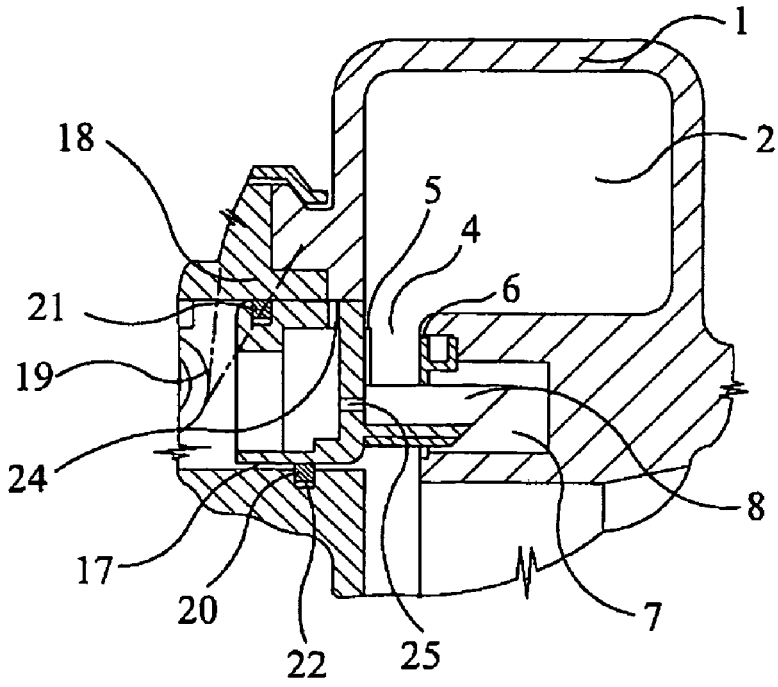
FIG. 2 is an axial cross-section of a part of a second embodiment to that of FIGS. 1*a* to 1*c;*
Figure 3:
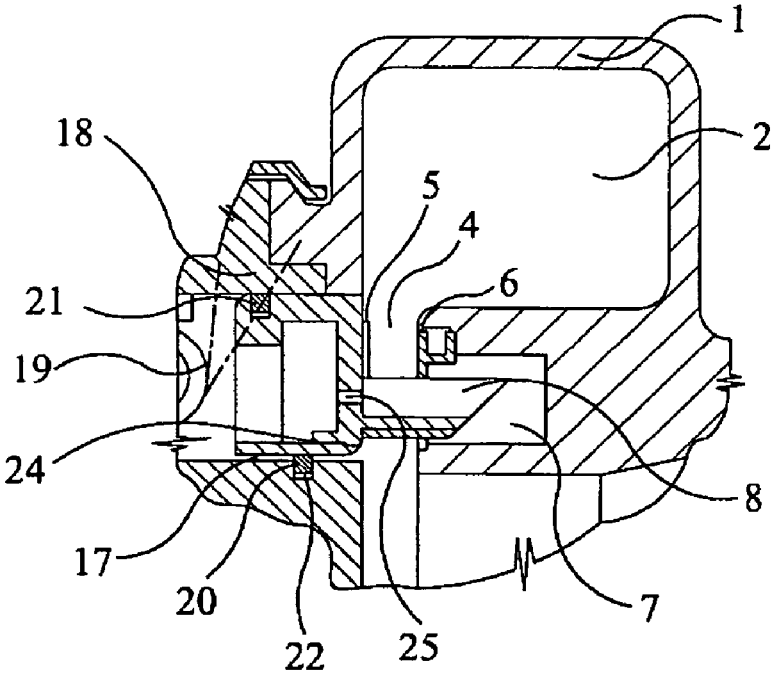
FIG. 3 is an axial cross-section of a part of a third embodiment of the invention.

FIGS. 2 and 3 illustrate second and third embodiments of the present invention. As with FIGS. 1*a* to 1*c*, only detail of the nozzle ring/inlet passageway region of the turbine is illustrated. Where appropriate, the same reference numerals are used in FIGS. 2 and 3 as are used in FIGS. 1*a* and 1*b*. FIGS. 2 and 3 each illustrate applications of the invention that differ from the embodiment of FIGS. 1*a* and 1*b* in only one respect.

In the embodiment of FIG. 2, the second pressure balance apertures 24 are provided in the outer flange 18 of the nozzle ring 5, while in the embodiment of FIG. 3, the second pressure balance apertures 24 are provided radially inward of the nozzle vane passage vanes 8 on the nozzle ring 5.

It will be appreciated that the second array of pressure balance apertures 24 may be provided at other radial positions. For instance, the second pressure balance apertures upstream of the first set of pressure balance apertures may at least partially lie within the vane passage, for example, a portion of each second pressure balance aperture may lie within the vane passage. Similarly, where the second set of pressure balance apertures is provided downstream of the first array of pressure balance apertures, the second pressure balance apertures may lie wholly or partially within the vane passage as opposed to outside the vane passage, as illustrated in FIG. 2. For instance, each second pressure balance aperture could lie entirely within the vane passage.

Figure 5:
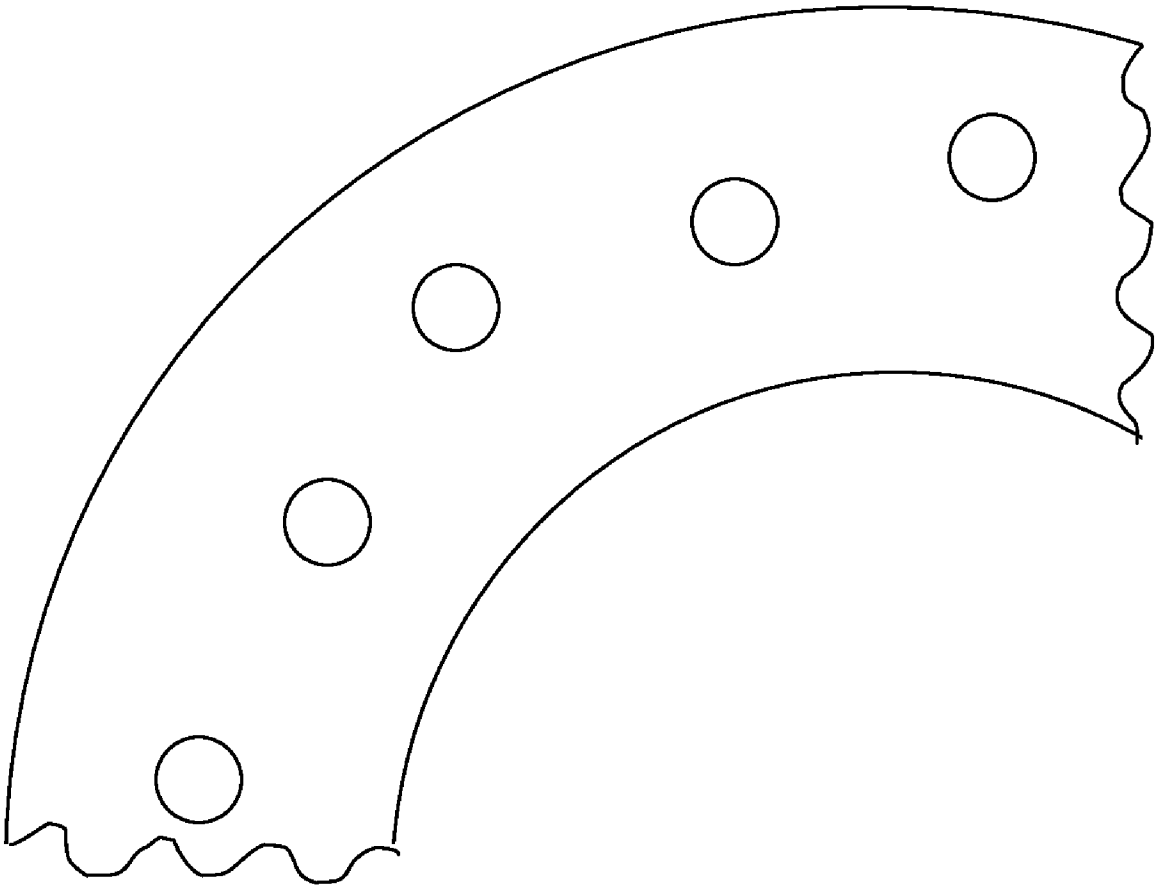
FIG. 5 depicts an embodiment of the invention.

In some embodiments of the invention there may be overlap between the radial extent of the first pressure balance apertures and the radial extent of the second pressure balance apertures (e.g. FIG. 5). For instance, a second array of pressure balance apertures upstream of the first pressure balance apertures may each have a radially inner most edge at a radius less than the radially outermost edge of each of the first pressure balance apertures. Similarly, where the second array of pressure balance apertures is provided downstream of the first pressure balance apertures, each pressure balance aperture may have a radially outer edge lying at a greater radius than the radially inner edge of each first pressure balance aperture.

It should be appreciated that the second pressure balance apertures 24 can be located within or outside the vane passage or in the inner or outer annular flanges.

Figure 4:
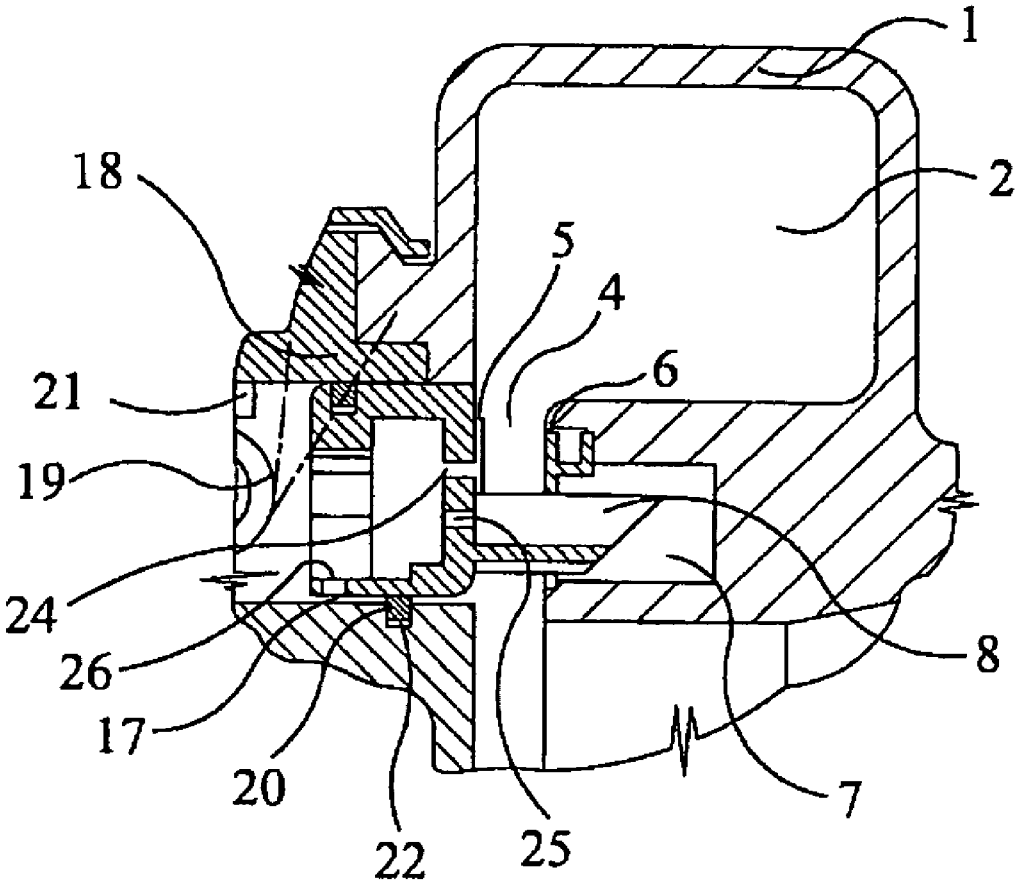
FIG. 4 is an axial cross-section of a part of a fourth embodiment of the invention.

FIG. 4 illustrates a fourth embodiment of the present invention. As with FIGS. 1, 2 and 3, only detail of the nozzle ring/inlet passageway region of the turbine is illustrated. Where appropriate, the same reference numerals are used in FIG. 4 as were used in the previous figures. FIG. 4 illustrates an application of the invention that differs from the embodiment of FIGS. 1*a* and 1*b* in one important respect: a bypass path is provided as disclosed in EP 1435434 (which is specifically incorporated herein by reference).

EP 1435434 discloses a turbine with a nozzle ring that is modified by the provision of a circumferential array of bypass apertures. The positioning of the bypass apertures is such that they lie on the side of the nozzle ring seal arrangement remote from the turbine inlet passageway except when the nozzle ring approaches a closed position used in an engine braking mode, at which point the apertures pass the seal. This opens a bypass flow path allowing some exhaust gas to flow from the inlet chamber to the turbine wheel via the cavity behind the nozzle ring rather than through the inlet passageway. The exhaust gas flow that bypasses the inlet passageway, and nozzle vanes, will do less work than the exhaust gas flow through the inlet passageway particularly since the vanes do not deflect the gas. In other words, as soon as the bypass apertures are brought into communication with the inlet passageway there is an immediate reduction in the efficiency of the turbocharger and corresponding drop in compressor outflow pressure (boost pressure) with an accompanying drop in engine cylinder pressure.

Thus, the provision of the inlet bypass apertures 26 will have no effect on the efficiency of the turbocharger under normal operating conditions, but when the turbine is operated in an engine braking mode, and the inlet passageway is reduced minimum, the bypass apertures will facilitate a reduction in inlet passageway 4 axial width without over pressurising the engine cylinders. It should be appreciated that the efficiency reducing effect on the turbocharger can be predetermined by appropriate selection of the number, size, and shape of the bypass apertures 26.

Referring again to FIG. 4, in accordance with the teaching of EP 1 435 434, bypass apertures 26 are provided through the inner flange 17 of the nozzle ring 5 in addition to primary and secondary pressure balance apertures 24 in accordance with the present invention.

In this embodiment the bypass passage is formed by the bypass apertures 26 in combination with the pressure balance apertures 24 and 25. This is one particular suggestion made in EP 1 435 434, although in that instance, only a single set of bypass apertures was provided within the vane passage, but the present invention can be combined with other embodiments of the invention disclosed in EP 1 435 434. In other words, the "dual" array of pressure balance apertures in accordance with the present invention can be applied wherever a single array of pressure balance apertures might otherwise be provided.

The first and second sets of apertures may have substantially the same sizes and shapes, or they may have substantially different sizes and/or shapes. In general, it is preferred that there be fewer apertures in the second set than in the first set, and that the apertures in the second set be smaller than the apertures in the first set.

In some embodiments, the first set of apertures may lie entirely within the vane passage, but in other embodiments a portion of each of the first set of apertures may lie outside the vane passage, either radially inward or outward thereof. Similarly, the second set of apertures will in some embodiments lie entirely outside the vane passage, but in other embodiments they may lie at least partially within the vane passage either upstream or downstream of the first set of apertures. For instance, it is possible that in some embodiments the first set of apertures may radially overlap with the second set of apertures in terms of their radial extent. Apertures may have a variety of shapes and need not necessarily be circular as described in the illustrated embodiments.

The invention claimed is:

1. A variable geometry turbine comprising a turbine wheel supported in a housing for rotation about an axis, an axially movable annular wall member mounted within a cavity provided within the housing, an annular inlet passageway extending radially inwards towards the turbine wheel and defined between a radial face of the movable wall member and an opposing wall of the housing, the movable wall member being axially movable relative to the housing to vary the axial width of the inlet passageway, an array of inlet guide vanes extending between the radial face and an opposing wall defining a radial vane passage, a first circumferential array of apertures provided through said radial face, each of said first array of apertures lying substantially within the vane passage, and a second circumferential array of apertures provided through said radial face, each of said second array of apertures lying substantially upstream or downstream of said first array of apertures relative to the direction of flow through the inlet, such that the inlet and said cavity are in fluid communication via both the first and second sets of apertures, wherein the total area of the second array of apertures is less than the total area of the first array of apertures by virtue of the second array of apertures having apertures that are substantially different from the first array of apertures in at least one of size, shape, and number.

2. A variable geometry turbine according to claim 1, wherein the moveable wall member is moveable between a fully opened position and a fully closed position, wherein both the first and second arrays of apertures are in fluid communication with both the inlet and the cavity for all axial positions of the movable wall member between the fully opened and fully closed positions.

3. A variable geometry turbine according to claim 1, wherein each of the first array of apertures is centered on a first radius and each of said second array of apertures is centered on a second radius, and wherein the second radius is greater than the first radius.

4. A variable geometry turbine according to claim 3, wherein said second radius is greater than the radius of the radially outer extent of said vanes.

5. A variable geometry turbine according to claim 1, wherein each of the first array of apertures is centered on a first radius and each of said second array of apertures is centered on a second radius, and wherein the second radius is smaller than the first radius.

6. A variable geometry turbine according to claim 5, wherein said second radius is smaller than the radius of the radially inner extent of said vanes.

7. A variable geometry turbine according to claim 1, wherein the entire area of each aperture in said first array lies within the vane passage.

8. A variable geometry turbine according to claim 1, wherein each of the second array of apertures lies at least substantially outside said vane passage.

9. A variable geometry turbine according to claim 1, wherein the full area of each aperture in the second array lies outside the vane passage.

10. A variable geometry turbine according to claim 5, wherein each of the second array of apertures lies at least substantially within said vane passage.

11. A variable geometry turbine according to claim 10, wherein each of the second array of apertures lies entirely within said vane passage.

12. A variable geometry turbine according to claim 1, wherein each aperture in said second array has a smaller area than each aperture in said first array.

13. A variable geometry turbine according to claim 12, wherein the apertures are circular and the diameter of each aperture in the second array of apertures is less than about 70% of the diameter of the apertures in the first array of apertures.

14. A variable geometry turbine according to claim 1, wherein the radial extent of the second array of apertures overlaps the radial extent of the first array of apertures.

15. A variable geometry turbine according to claim 1, wherein there are fewer apertures in said second array than in said first array.

16. A variable geometry turbine according to claim 15, wherein there are about 50% fewer apertures in the first array than in the second array.

17. A variable geometry turbine according to claim 2, wherein each of the first array of apertures is centered on a first radius and each of said second array of apertures is centered on a second radius, and wherein the second radius is greater than the first radius.

18. A variable geometry turbine according to claim 2, wherein each of the first array of apertures is centered on a first radius and each of said second array of apertures is centered on a second radius, and wherein the second radius is smaller than the first radius.

19. A variable geometry turbine according to claim 11, wherein each aperture in said second array has a smaller area than each aperture in said first array.

20. A variable geometry turbine according to claim 13, wherein the radial extent of the second array of apertures overlaps the radial extent of the first array of apertures.

21. A variable geometry turbine according to claim 1, wherein the vanes are attached to the movable wall member.

22. A variable geometry turbine according to claim 1, wherein the movable wall member is axially movable relative to the housing along an axis and wherein the vanes are axially movable along the axis.

* * * * *